United States Patent [19]

Bechtold et al.

[11] Patent Number: 4,594,821

[45] Date of Patent: Jun. 17, 1986

[54] SKYLIGHT ASSEMBLY

[76] Inventors: Paul E. Bechtold, 26 Kaywood Rd., Port Washington, N.Y. 11050; Stephen K. Bechtold, 28 Soundview Ave., East Northport, N.Y. 11731

[21] Appl. No.: 706,236

[22] Filed: Feb. 27, 1985

Related U.S. Application Data

[63] Continuation of Ser. No. 492,409, May 6, 1983, abandoned, which is a continuation of Ser. No. 172,381, Jul. 25, 1980, abandoned.

[51] Int. Cl.[4] ..... E04B 7/16; E04D 13/03

[52] U.S. Cl. ..... 52/72; 52/200; 16/389

[58] Field of Search ..... 52/200, 72; 16/121, 16/389; 49/402; 217/60, 57

[56] References Cited

U.S. PATENT DOCUMENTS

| | | | |
|---|---|---|---|
| 751,496 | 2/1904 | Gode | 16/121 |
| 919,154 | 4/1909 | Gen | 16/389 |
| 1,483,624 | 2/1924 | Walker | 217/60 |
| 2,115,656 | 4/1938 | Thompson | 217/60 |
| 2,875,710 | 3/1959 | Bechtold | 52/72 |
| 2,978,927 | 4/1961 | Blanton | 16/121 |
| 3,047,983 | 8/1962 | Wasserman | 52/72 |
| 3,090,613 | 5/1963 | Bechtold | 52/72 |
| 3,399,500 | 9/1968 | Shapiro | 52/72 |
| 3,417,522 | 12/1968 | Kiekhaefer | 52/200 |
| 3,417,527 | 12/1968 | Kiekhaefer | 52/200 |
| 3,434,250 | 3/1969 | Kiekhaefer | 52/200 |
| 3,505,762 | 4/1970 | Sandow et al. | 52/72 |
| 3,557,497 | 1/1971 | Schafer et al. | 52/72 |
| 4,073,097 | 2/1978 | Jentoft et al. | 52/200 |
| 4,223,493 | 9/1980 | Moench et al. | 52/200 |
| 4,408,422 | 10/1983 | Bechtold | 52/72 |
| 4,441,284 | 4/1984 | Bechtold | 52/72 |

FOREIGN PATENT DOCUMENTS 20941 of 1907 United Kingdom ..... 49/357

*Primary Examiner*—Donald G. Kelly
*Assistant Examiner*—Michael Safavi
*Attorney, Agent, or Firm*—Hoffmann, Dilworth, Barrese & Baron

[57] ABSTRACT

A skylight and roof assembly with at least a portion of the skylight adapted to be pivoted by a drive mechanism between open and closed positions with respect to an opening in the roof. At least one hinge is connected to the movable portion of the skylight and the fixed portion of the assembly to permit the pivotal movement. The hinge includes a first leg adapted to be mounted on the movble portion of the skylight in fixed position. The hinge includes a second leg adapted to be mounted on the non-movable portion of the skylight and roof assembly. A flange extends from the second leg and mating surfaces are on the first leg and the flange adapted to receive a coupling pin for pivotally interengaging the first and second leg with the first leg spaced from the second leg by the flange therebetween so that the movable portion of the skylight can be pivoted in a desired manner between the open and closed position. An actuator pole is provided for removably engaging and activating the drive mechanism to pivot the skylight portion. The pole is formed of two separable sections, an upper section and a lower section. A spline interconnects the two sections. A handle is removably connected to the lower section and a connector is removably connected to the upper section and is designed for removable engagement with the drive mechanism so that when the handle is shifted the connector activates the drive mechanism and pivots the skylight.

3 Claims, 10 Drawing Figures

FIG. 5
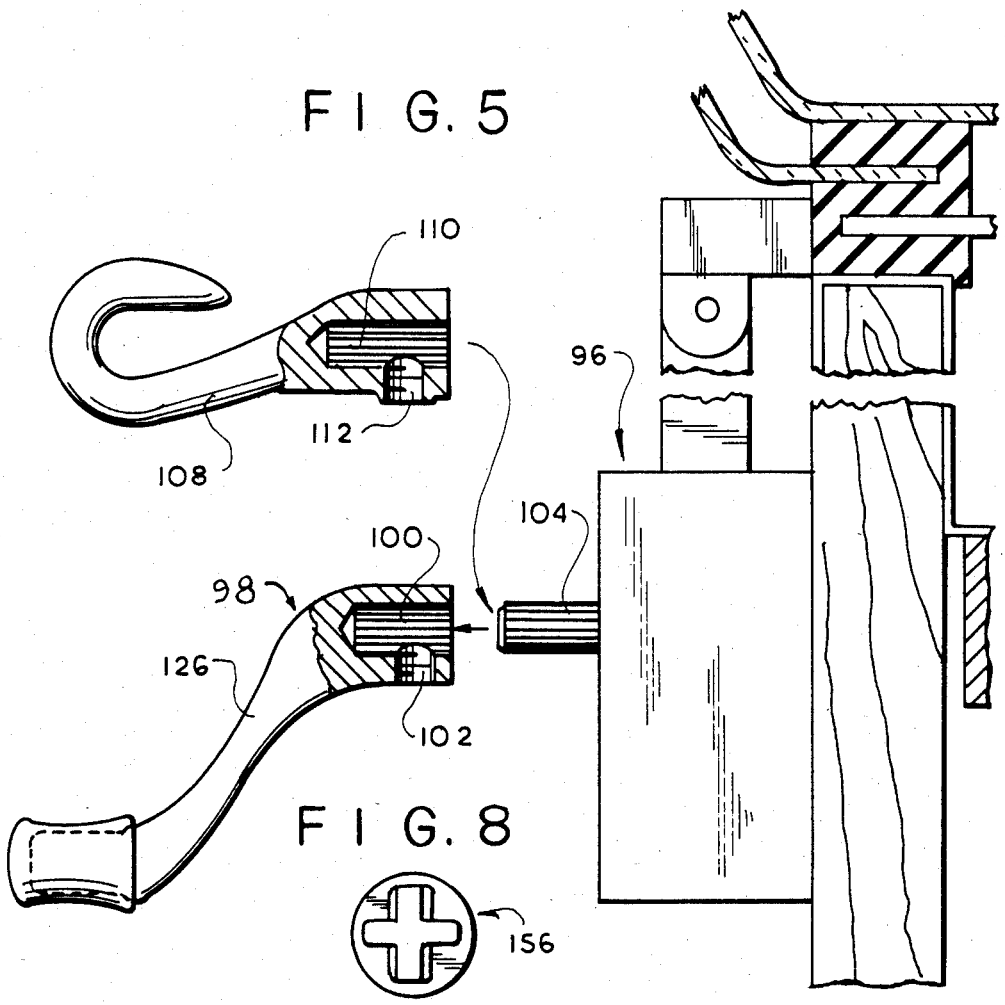
FIG. 8
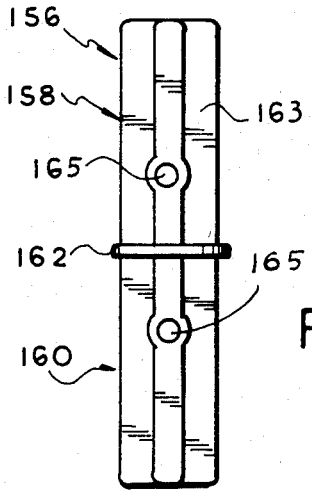
FIG. 7

FIG. 5A
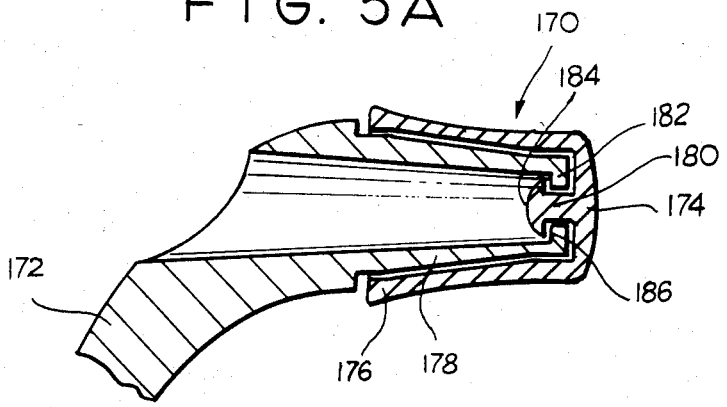
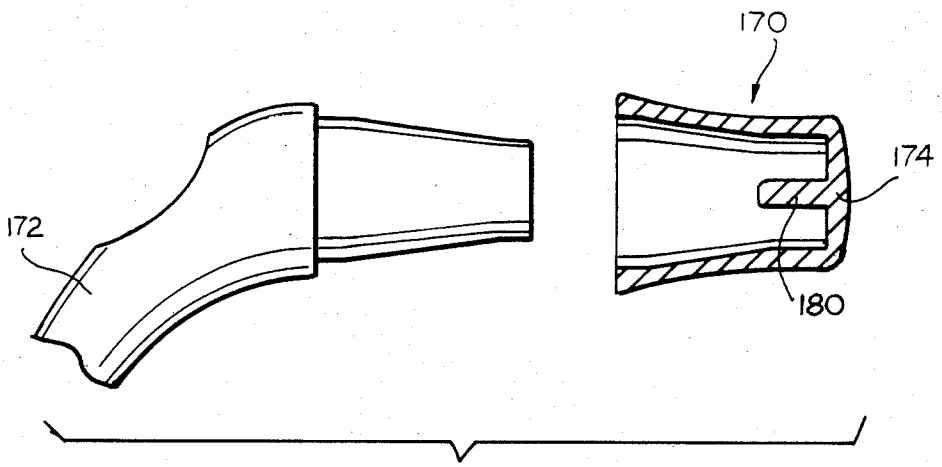
FIG. 5B

SKYLIGHT ASSEMBLY

This is a continuation of application Ser. No. 172,381, filed July 25, 1980 which is a continuation of Ser. No. 492,409, filed May 6, 1983 both now abandoned.

BACKGROUND OF THE INVENTION

In skylight construction for building roofs and other similar overhead structures, there have been a variety of different types of skylights and hatches developed including designs adapted to be opened and closed.

In opening the skylights there are a number of advantages that are generally sought. For example, it is desirable to have the skylight open and close freely and easily. Also, the skylight should be designed so that it can be opened to a substantial degree for those occasions when substantial or complete access through the opening in the roof structure is desired.

Naturally, it is also desirable to provide a structure that is weather proof and leak proof as well as being adapted to be inserted as a unit into a finished roof, and open upwardly. This is one of the criteria which is certainly desirable since it reduces the construction and installation cost of the unit. With the same thought in mind, it is naturally desirable to provide inexpensive component parts for the skylight assembly including parts which are inexpensive to manufacture, install and utilize. The parts should be designed so that they promote the desirable features of the skylight, for example, in connection with hinges for the movable portion of the skylight. The hinge should be designed so that it provides for free and easy opening and closing of the skylight in a quick and efficient manner.

A successful skylight design of the type under consideration is disclosed in inventor's prior U.S. Pat. No. 3,090,613 issued May 21, 1963, the contents of which are incorporated herein by reference.

SUMMARY OF THE INVENTION

With the above background in mind, it is among the primary objectives of the present invention to provide an improved skylight assembly for a roof or hatch use, particularly with significant hardware improvements. For example, an improved and simplified hinge structure is presented. The hinge is designed to be of low cost and to be easily and efficiently installed and used thereby decreasing assembly and installation cost. The hinge is designed so that it provides for freely pivotal movement of the portion of the skylight to be opened so that substantially free access can be obtained to the opening in which the skylight is mounted.

More specifically, the hinge is designed to provide for spacing of the portion of the hinge mounted on the pivotal portion of the skylight and the portion of the hinge mounted to the fixed portion of the assembly so that the skylight has freedom of movement about the pivot point and can be opened substantially greater than 90° of rotation from the closed position.

It is contemplated that the hinge of the present invention can be formed of stainless steel, be provided with a pivot pin spun on both ends, and is designed to eliminate the necessity of the use of a shim to accommodate varying thickness occurring during assembly of parts. The hinge is easily mounted by the use of as few as only two self tapping fastener elements.

It is a further objective to provide a hinge that is prebent into the desired configuration for use in the skylight assembly, includes the correct size and placement of holes for ease and efficiency of assembly, and includes only three pieces which provides for a great reduction in the number of component parts for the hinge structure thus adding to the efficiency and reducing the cost in assembly and installation. The design of a hinge of the present invention also makes it possible to easily replace hinges without requiring disassembly of major components of the skylight structure.

A still further objective of the present invention is to provide a unique actuator pole for facilitating access to the mechanism for opening and closing the skylight assembly. Since in most instances the skylight is mounted in a roof structure, access to the opening and closing mechanism of the skylight is often difficult. Accordingly, an improved structure for actuating the drive mechanism for the skylight assembly is always a desirable feature. Accordingly, a unique actuator pole is provided which is separable into two easily storable and portable halves. The two sections or halves are interconnected by a unique spline mechanism which facilitates ease of assembly and disassembly for use and storage respectively. Additionally, the pole is designed so that the one section can be easily interconnected with a handle for rotating the pole and the other section easily removably connected with a connector for coupling with the drive mechanism so that when the handle is grasped and the pole is rotated the connector attached to the drive mechanism will activate the drive mechanism and open and close the skylight according to the direction of rotation of the pole. The same type of structure employed in the spline can be employed on the handle and the connector for facilitating ease of coupling with the two sections of the pole. It is contemplated that the connector can be in the form of a loop and the means for receiving the loop on the drive mechanism of the skylight assembly can be a hook. The hook can be designed in a conventional manner to be removably mounted to the drive mechanism and replaced by a suitable handle for those uses where the drive mechanism is easily reachable and the actuator pole is not necessary.

A further improvements resides in the construction of the handle of the pole. A rotatable knob is employed to facilitate use of the handle. The knob is substantially soundless and the ability is aided by the unique design which provides for a cup-like receptacle to retain lubricant during use. The knob is coupled with the remainder of the handle in quick, efficient and inexpensive manner. No additional fasteners or other components are required. The assembly is a two piece knob and body structure.

In summary, an improved hinge is provided for a skylight and roof assembly having a skylight portion thereof pivotable between open and closed positions. The hinge includes a first leg adapted to be mounted on the movable or pivotable portion of the skylight in fixed position. A second leg of the hinge is adapted to be mounted on the fixed portion of the assembly and fixed in position thereon. A flange extends from the second leg of the hinge and mating surfaces are on the first leg and the flange adapted to receive coupling means for pivotally interengaging the first and second leg with the first leg spaced from the second leg by the flange therebetween so that the pivotable skylight portion can be pivoted between the open and closed positions along a desired arcuate path.

An actuator pole is provided for removably engaging and activating a drive mechanism for the skylight assembly to pivot the skylight portion of the assembly. The pole is formed of two separable sections, an upper section and a lower section. A spline is provided for interconnecting the two sections. A handle is removably connected to the lower section and a connector is removably connected to the upper section for removable engagement with the drive mechanism so that when the handle is shifted the connector will activate the drive mechanism and pivot the skylight.

With the above objectives among others in mind, reference is made to the attached drawings.

BRIEF DESCRIPTION OF THE DRAWINGS

In The Drawings

FIG. 5 is an enlarged partially sectional plan view of a fragmentary portion of the skylight assembly showing the drive mechanism and a removable hook and a removable handle for use in operating the drive mechanism;

FIG. 5A is a fragmentary sectional view of the knob position of the removable handle of FIG. 5;

FIG. 5B is a partially sectional view of the knob of the handle of FIG. 5A prior to assembly with the body of the handle;

FIG. 7 is a plan view of the spline for connecting the two sections of the actuator pole; and FIG. 8 is an end view of the spline of FIG. 7.

DETAILED DESCRIPTION

Figure 1:
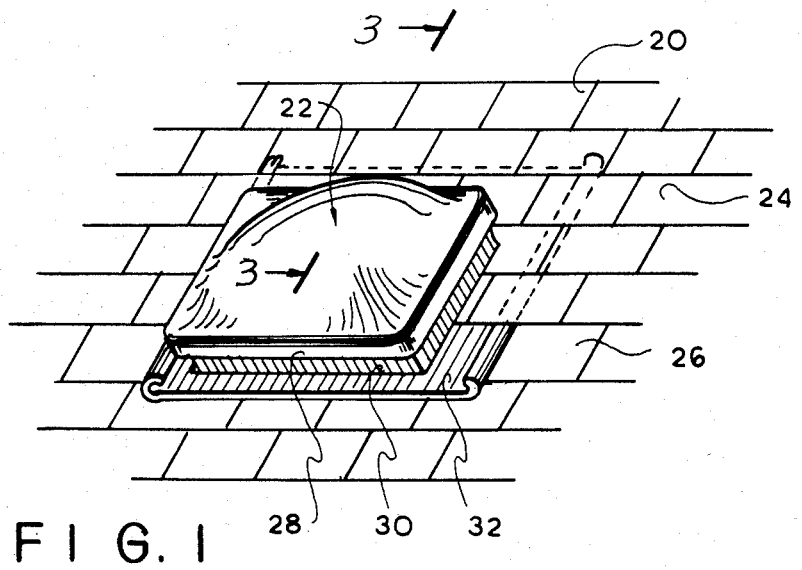
FIG. 1 is a plan view of a skylight assembly of the invention mounted on a roof.

In FIG. 1 a roof 20 is shown with a skylight assembly 22 incorporating the present invention mounted thereon. Roof 20 includes conventional roof sheathing 24 covered by an overlay of conventional shingles 26. Skylight 22 includes a swinging window unit 28 and box-like frame 30 as well as a flashing frame 32. The frames for skylight 22 can be formed of metal such as aluminum or from suitable lumber.

Skylight 22 includes a dome-shaped or exteriorly convex light-transparent window 34. In this connection, window 34 may be formed from a suitable resinous material commercially employed for such purposes. Window 34 preferably terminates along its periphery in a depending integral skit 36. Window 34 can be formed for example of clear acrylic plexiglas. Window 34 forms an outer dome which is spaced from an inner insulating dome 38 of similar material which is preferably clear or white translucent. The peripheral edge portion 40 of inner dome 38 is sealed as are the peripheral end portions of outer dome 34. Insulation is facilitated by the insulating space 42 between the inner and outer domes.

An extrusion 44 of conventional sealing material such as rubber is used to seal the peripheral edges of the double dome structure. Upper dome 34 rests on the upper surface 46 of extrusion 44 and is anchored to the supporting frames of the assembly in a conventional manner.

Extrusion 44 is seated on the upper surface 48 of flashing frame 32 and on the exposed upper surface 49 of hinges 50 as it extends around the periphery of the skylight assembly 22. A recess 52 in one side of extrusion 44 receives the end portion 40 of inner dome 38 in sealing interengagement. A second recess 54 below recess 52 and extrusion 44 and open outwardly and opposite to the opening to recess 52 receives an end of box frame 30 therein to provide an additional seal in the outward direction.

Hinge 50 is affixed to flashing frame 32 and to box frame 30 with the pivot point of the hinge positioned so that the interconnected box frame, extrusion and double dome portion of the skylight can pivot with respect to the flashing frame 32 thus permitting the shifting of the skylight between the open and closed positions.

In the depicted embodiment, there are two hinges 50 along one side of the rectangularly shaped skylight 22 so that the other three sides are free to permit movement of the double dome window portion away from the remainder of the skylight structure to permit access to an opening in alignment therewith in roof 20.

Figure 2:
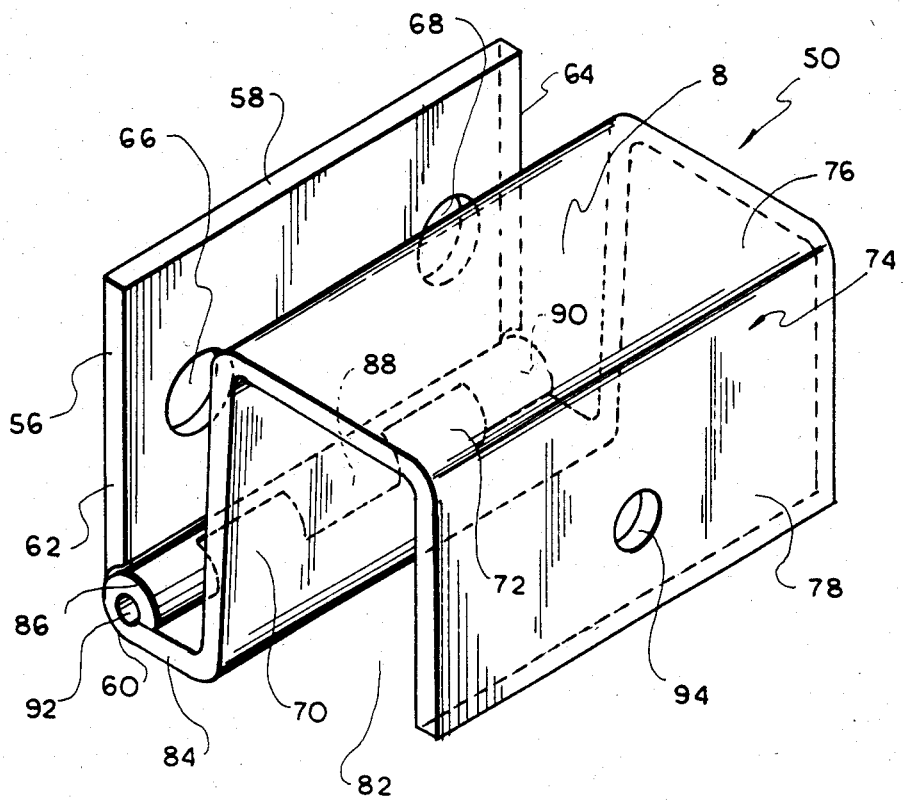
FIG. 2 is a perspective view of a hinge used in the skylight assembly of the invention.
Figure 3:
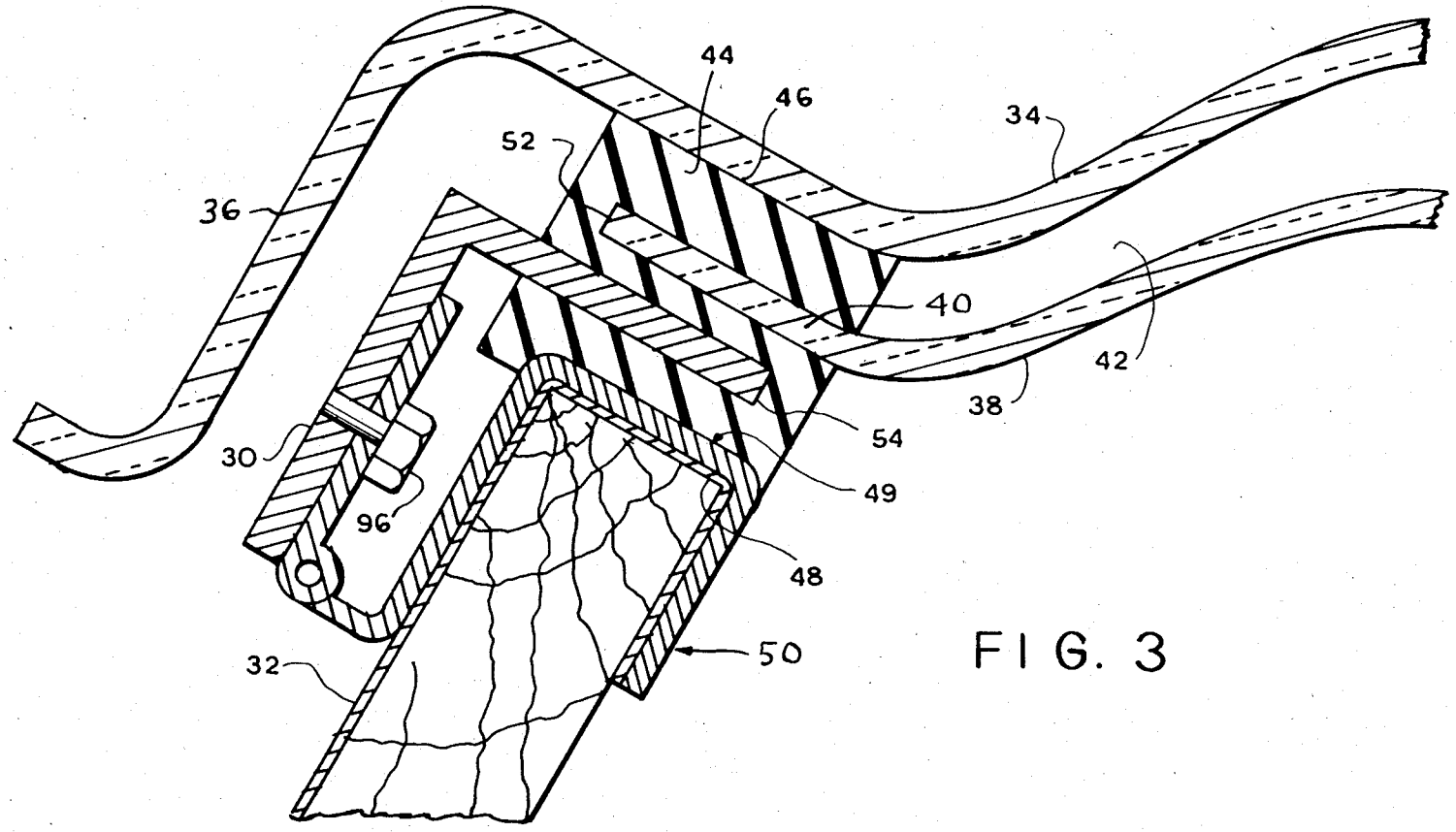
FIG. 3 is an enlarged fragmentary sectional view of the skylight assembly taken along the plane of line 3—3 of FIG. 1.

The details of each hinge 50 can be easily seen in FIG. 2. The hinge includes a first leg 56 which is of substantially rectangular configuration with longer upper and lower edges 58 and 60 respectively and a pair of shorter front and rear edges 62 and 64 respectively. A pair of mounting holes 66 and 68 are positioned interiorly of the edges of leg 56.

A pair of spaced hollow tubular projections 70 and 72 extend laterally from bottom edge 60.

Hinge 50 has a second U-shaped leg 74 with the closed end forming an upper base wall 76 for two spaced side walls 78 and 80 extending downwardly therefrom to provide an opening 82 therebetween. Base wall 76 and side walls 78 and 80 are also substantially rectangular in configuration generally conforming to the sides and shape of first leg 56. The U-shaped second leg 74 has a lateral flange 84 extending from the free end of side 80 adjacent to opening 82. Flange 84 terminates in three hollow tubular projections 86, 88 and 90 which are spaced along the length of flange 84 and are positioned to mate with projections 70 and 72 on first leg 56 so that the openings through all of the aligned projections are also aligned. A pin 92 is inserted through the aligned openings in the five projections to form the coupling means for coupling the two legs together and the pin 92 also forms the pivot axle about which the first leg 56 and the second leg 74 can rotate.

Side 78 has a hole 94 therethrough for extension of a conventional fastener element to mount the U-shaped legs 74 in fixed position on the skylight assembly 22.

Thus, each hinge 50 is formed of only three components, first leg 56, second leg 74, and pivot pin 92. It can be quickly and efficiently mounted to the skylight assembly 22. First leg 56 is mounted in a conventional manner to the movable portion of the skylight, for example, as shown in the depicted embodiment by the use of conventional self-tapping fasteners 96 passed through holes 66 and 68 of first leg 56 and into box-like frame 30. In turn, the U-shaped leg 74 is positioned over the upper end of flashing frame 32 so that the upper surface 48 of the flashing frame seats against the inner surface of space 76. A suitable self-tapping fastener is then passed through opening 94 in side 78 of legs 74 into flashing frame 32 to complete the mounting of the hinge to the fixed non-movable portion of the skylight assembly 22.

Figure 4:
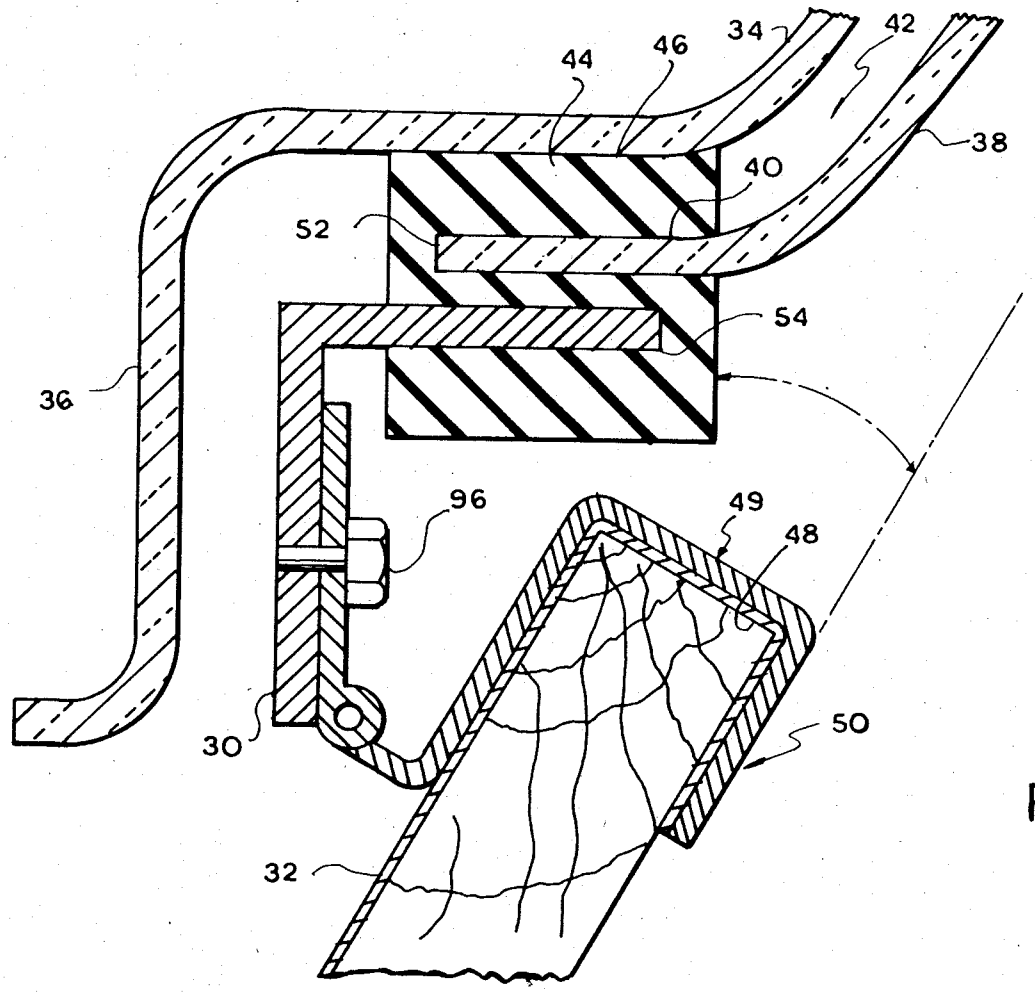
FIG. 4 is an enlarged fragmentary sectional view of the portion of the invention shown in FIG. 3 with the movable portion of the skylight assembly having been shifted to an open position.

The assembly is then ready for use and is quickly and efficiently mounted to the roof structure to arrive at the position depicted in FIG. 1. The skylight is then operated in a conventional manner and the double window structural portion is rotated about pivot pin 92 to open the skylight to a desired degree. By positioning pivot pin 92 at the bottom end of leg 56 and side 80 and by making the leg 56 and the side 80 of sufficient length along with providing flange 84 to space the pivot pin 92 a predetermined distance from fixed U-shaped leg 74, substantially free rotation of the movable window portion of the skylight assembly is achieved. As shown in FIG. 4, the pivoting can be carried out over a considerable angular degree. In the embodiment shown, the dome can be opened more than 90°. This is a desirable feature particularly if the unit is to be used as a hatch where access to the complete opening in the roof is desired. Naturally in other environments including simply a window structure, the ability to open the dome to a greater degree is also extremely desirable.

As shown in a depicted embodiment, there are two hinges 50 employed in the assembly. Naturally the number of hinges is a matter of choice with two being an example of a convenient acceptable number.

Hinges 50 can be formed of a conventional metal material such as stainless steel. Pin 92 can be spun at both ends to avoid any problem of the pin falling out during use. The lateral width of flange 84 is a matter of choice depending upon the desired amount of freedom of movement one wishes in the chosen design criteria. The present hinges eliminate the necessity of the use of shims to accommodate for varying thicknesses and components since there is sufficient clearance for free rotation over a range of tolerances in component parts. A minimum number of fasteners are required to mount the hinges in place. There are no secondary bending operations required for the hinges which are formed in their intended use configuration during manufacture.

The holes in the hinge legs are preformed in the desired arrangement for ease of assembly and installation of the skylight assembly 22. As stated above, each hinge 50 is formed of only three pieces thus reducing cost in manufacture and assembly. Maintenance and repair is facilitated by the fact that the hinges can be easily removed and replaced without the necessity of dome disassembly and can be used to retrofit existing units.

The drive mechanism 96 is depicted in FIG. 5 and is used to open and close skylight in a conventional manner such as described in connection with U.S. Pat. No. 3,090,613. The drive mechanism is shown with a conventional handle 98 which has a recess 100 in one end and a set screw 102 for removably mounting the handle on the drive mechanism 96 in a conventional manner. For this purpose a spindle 104 is provided whereby when the handle 98 is mounted on the spindle rotation of the handle will operate the drive mechanism to open and close the skylight depending upon the direction of rotation of the handle. The surfaces surrounding recess 100 in handle 98 are provided with a plurality of ribs and the spindle 104 also has ribs on its outer surface to facilitate alignment and orientation of the handle for desired use when it is coupled with the drive mechanism.

Figure 6:
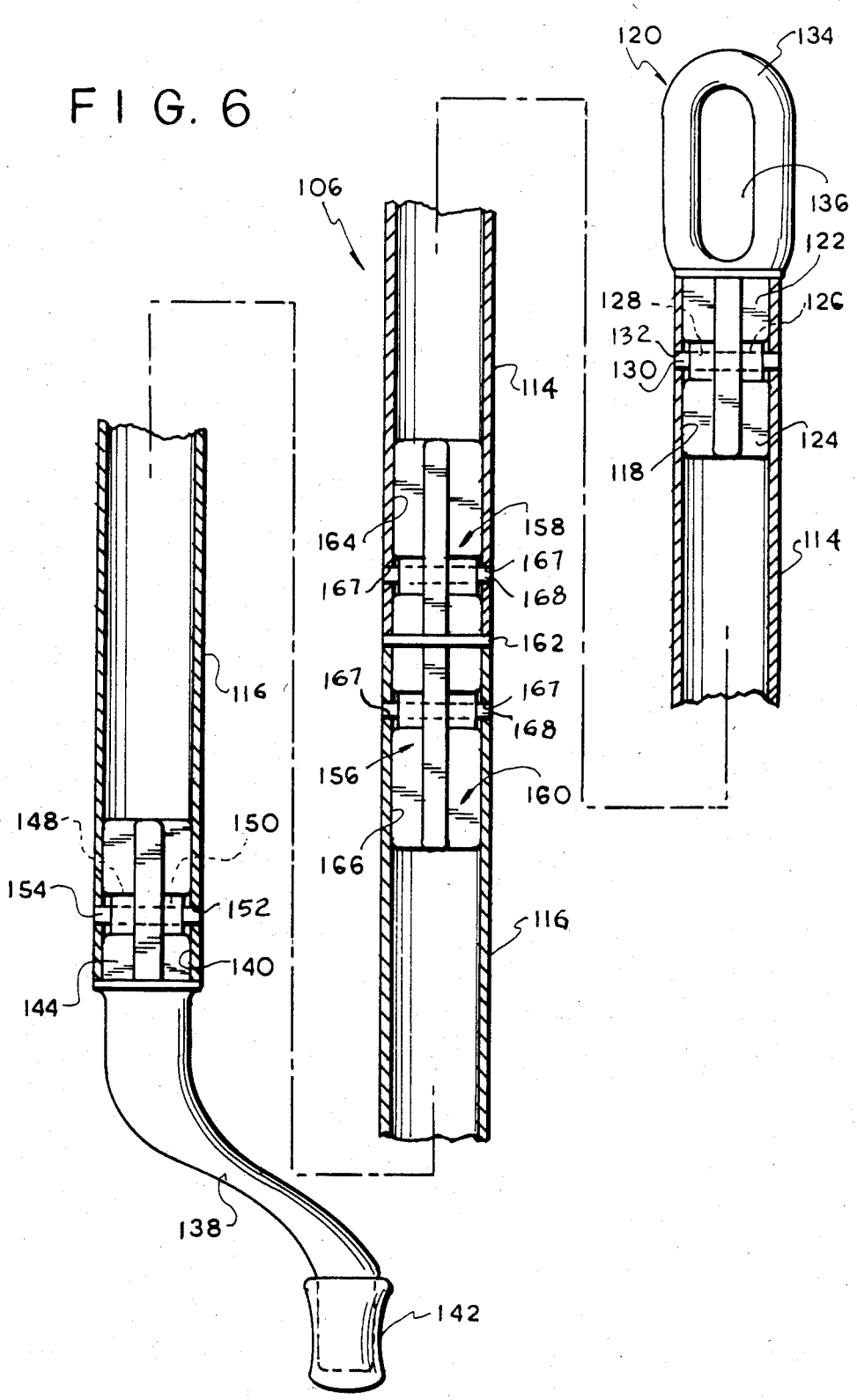
FIG. 6 is a partially sectional view of the actuator pole for operating the drive mechanism in assembled condition with parts broken away and removed.

Alternatively, in connection with the present invention a unique actuator pole 106 has been devised to facilitate operation of drive mechanism 96 when it is in a relatively inaccessible position such as on a ceiling or roof structure which is commonly the case. Actuator pole 106 is shown in detail in FIGS. 6–8 of the drawings. Where the actuator pole is to be used, handle 98 is removed from spindle 104 of drive mechanism 96 and is replaced by a hook 108. The hook has a similar recess 110 to recess 100 in the handle including appropriate ribs to facilitate alignment and orientation for use and an appropriate set screw 112 for mounting of the hook on the spindle 104. In this manner, rotation of hook 108 will rotate spindle 104 and accordingly open and close the skylight depending upon the direction of rotation.

Pole 106 is designed for ease of assembly for use and disassembly for handling, transportation and storage. It includes two tubular sections, an upper section 114 and a lower section 116. The two sections 114 and 116 are substantially the same in length and dimension and can be hollow throughout their length as shown or can be provided with recesses on either end. The open upper end 118 of upper section 114 is designed to receive one end of a connector 120. The end 122 of connector 120 which is inserted into opening 118 of section 114 includes four longitudinally extending spaced ribs 124 which are angularly spaced at approximately 90° intervals so that they are at right angles to one another. A pair of aligned openings 126 and 128 are in opposing ribs and are adapted to receive an appropriate fastener 130 which is passed through and aligned opening 132 in the side wall of the upper section 114. By means of fastener screw 130, the connector is coupled with the upper section 114 after having been inserted therein. Ribs 122 are dimensioned so that they frictionally fit with the inner surface walls of the tubular upper section and facilitate coupling of the connector to the tubular section and interconnection therebetween. Extending outwardly from portion 122, inserted in tubular upper section 114, is a closed loop 134. The hole 136 in loop 134 is dimensioned to engage with hook 108 so that when the loop 134 is rotated, the hook 108 will be rotated and accordingly spindle 104 will be rotated.

A handle 138 is designed to be interengaged with the open lower end 140 of lower section 116 in the same manner that connector 120 is coupled with upper section 114. A lower handle portion 142 extends from a coupling portion 144 which is provided with a rib arrangement 146, similar to the ribs on connector 120, for insertion into open end 140 of section 116. Opposing holes 148 and 150 in ribs 146 are positioned to be aligned with suitable openings 152 in the tubular side wall of lower section 116 for passage of a screw fastener 154 through each pair of aligned apertures to removably mount the handle 138 to lower section 116 of the pole.

The two sections 114 and 116 are coupled by means of a spline 156 which has two matching halves 158 and 160 abutting at an annular disc portion 162. Half 158 is inserted in lower end 164 of upper section 114 and the other half 160 is inserted in upper open end 166 of lower section 116. Insertion is complete when the lower edge of upper section 114 and the upper edge of lower section 116 abut against the opposing sides of annular disc 162 substantially at the center of spline 156.

The spline is designed to be coupled with the sections 114 and 116 in the same manner as connector 120 and handle 138 were connected with the sections 114 and 116. Each spline half 158 and 160 is identical as shown in detail in FIGS. 7 and 8 and includes four longitudinal ribs 163 which are angularly spaced at approximately 90° to one another. The ribs 163 are rectangular in configuration having straight edges to facilitate frictional interengagement with the tubular wall on the interior of the upper and lower sections and the coupling of the two sections together in assembling the pole 106. The spaced ribs on the spline and all of the parts inserted into the upper and lower sections of the pole accommodate dimensional variations in the tubular pole sections such as wall thickness and inner diameter thereby facilitating mass production and low manufacturing and assembly cost. The spaces between the ribs will permit deformation of the tubular sections in tight fitting condition in contrast to a tubular to tubular mating arrangement which would not permit any meaningful deformation and would require much closer tolerances. The perpendicular arrangement of ribs 163 can be seen clearly in FIG. 8. A pair of opposing holes 165 are in diametrically opposed ribs for alignment with appropriate receiving holes 167 in the upper and lower section. A suitable screw type fastener 168 can then be passed through the aligned openings to mount the spline to the upper and lower sections 114 and 116 in a quick and efficient manner to complete the assembly of the actuator pole 106.

In use, the pole can be stored in disassembled or assembled condition. If it is in disassembled condition, it can be quickly, easily and efficiently assembled. All that is required is that the two sections 114 and 116 be interconnected through the use of spline 156, as described above, and in a similar manner connector 120 is coupled with the upper end of section 114 and handle 138 is coupled with the lower end of section 116. In that assembled condition, the pole can then be coupled with hook 108 by passing the hook through hole 136 in loop 134. Thereafter, by rotating handle 138 and accompanying rotation of the coupled sections 114 and 116 and connector 120, hook 108 will be rotated. This rotates interconnected spindle 104 and causes the drive mechanism to operate the skylight to open and close it. Naturally, the direction of rotation of the pole will determine whether the skylight is being opened or closed. After use, the pole can be put aside and stored in assembled condition or can be quickly and easily disassembled for transportation and storage. Actuator pole 106 is inexpensively formed of a minimum number of components. All that is required are two tubular sections, a handle, a connector and a spline. Actually, the screw type fasteners for assembly purposes are optional since the rib type structures can all be dimensioned so that frictional interengagement between the ribs and the inner walls of the tubular sections is sufficient to maintain the pole in assembled condition during use.

Both handles 98 and 138 of the above discussed embodiments have similar gripping portions. The details of the gripping portion are depicted in detail in FIGS. 5A and 5B. Each gripping portion includes a knob 170 mounted on a body 172. The knob 170 is mounted on the end of the body and is cup-shaped in configuration with a closed end 174 and an open end 176. The open end 176 is formed as a recess to conform with the end portion 178 of the body 172. Recess 176 has a slightly larger diameter than portion 178 on the body so as to provide clearance for rotation thereabout. The closed end 174 of the knob is provided with an internal pin 180 which extends through a receiving aperture 182 in the end portion 178 of the body during assembly. The tip 184 of the pin 182 is then deformed or enlarged by a convenient means such as spinning to prevent its withdrawal back through aperture 180 due to the presence of an internal shoulder 186 on the interior of the end portion 178 of the body. The deformation of the tip 184 is done in a conventional manner and in a fashion so that clearance is provided between the pin and the body as well as between the closed end 184 of knob 170 and the body 172. Thus, knob 170 is mounted in fixed position on the body 172 and is freely rotatable with respect thereto. The clearance therebetween provides for free rotation and avoids frictional interengagement and undesirable binding and noise occurrence. Also, the clearance between the parts and the cup-shaped configuration of the knob provides a receptacle for lubricant. By lubricating the knob and body in this manner, noise and binding effects are alleviated for extended periods of time. The handle formed in this manner is inexpensive and easy to manufacture and assemble. It is formed of only two components and interconnected by a conventional effecient manner such as the spinning down of the pin to form a rivet like interconnection.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. In a skylight and roof assembly including a skylight portion mounted over an opening in the roof and pivotable between open and closed positions and of the type including an inner dome and an outer dome spaced from one another, a sealing extrusion around the periphery of the domes to sealingly engage with the remainder of the skylight and roof assembly when the skylight portion is in the closed position, the periperal edge of the inner dome mounted to the extrusion and the outer dome having a portion adjacent its outer edge on sealing engagement with the extrusion and the outer edge extending beyond the extrusion and into overlying spaced position with respect to the remainder of the skylight and roof assembly and engageable therewith when the skylight portion is opened to limit the extent to which the skylight portion can be opened, the improvement comprising; at least one hinge mounted on the assembly, each hinge including a first leg mounted on the movable portion of the assembly in a fixed position and a second leg mounted in fixed position on the fixed portion of the assembly, a flange extending from the second leg, and mating surfaces on the first leg and the flange receiving coupling means for pivotally interengaging the first and second leg by the flange therebetween so that the skylight can be pivoted between the open and closed positions along a desired arcuate path, the first leg having means thereon for mounting the first leg to the movable skylight portion, the second leg being U-shaped in configuration to capture a fixed portion of the assembly therein to be mounted thereon in fixed position, the flange having a predetermined size and the surfaces to receive the coupling means on the end of the flange being distal from the U-shaped leg, to permit pivoting of the movable skylight portion with respect to the fixed portion of the assembly so that it covers the roof opening when in the closed position with the extrusion in sealing engagement with the remainder of the skylight and roof assembly about substantially the entire periphery thereof and substantially across the width of the sealing extrusion and can be opened to expose the roof opening by pivoting the movable skylight portion more than 90 degrees away from the closed position by providing the outer edge of the upper dome with sufficient spacing from the fixed portion of the skylight and roof assembly.

2. The invention in accordance with claim 1 wherein the skylight portion is pivotable by a drive mechanism between open and closed positions, a handle is removably connectably to the drive mechanism so that shifting of the handle will activate the drive mechanism and pivot the skylight, the handle being formed of substantially rigid material and including an integrally formed knob of substantially rigid material rotatably mounted on one end of a body portion of the handle with the other end of the body portion being removalby engaged with the drive mechanism, the knob being closed at one end and open at the other to form a recess and have a cup-like configuration, a pin extending from the closed end of the knob into the recess therein, the cup-shaped knob being rotatably positioned on the end of the body portion with the pin extending into a recess in the end of the body portion and being deformed after having been inserted therein to retain the knob on the body portion and rotatable thereabout, the deformation of the pin taking place at its free end with the portion between the ends of the pin having a slightly smaller diameter than the diameter of the entry to the recess in the end of the body so as to provide space therebetween and to permit relative rotation between the knob and body, and the diameter of the recess forming the cup-like configuration on the interior of the knob being greater than the outer diameter of the body portion extended thereon to provide a predetermined size space therebetween so as to faciliate relative rotation therebetween and prevent interference and to provide a receptacle for retaining lubircant to enhance relative rotation action between the knob and body.

3. A hinge for a skylight and roof assembly having a skylight portion thereof pivotable between open and closed positions and the type including an inner dome and an outer dome spaced from one another, a sealing extrusion around the periphery of the domes to sealingly engage with remainder of the skylight and roof assembly when the skylight portion is in the closed positon, the peripheral edge of the inner dome mounted to the extrusion and the outer dome having a portion adjacent its outer edge on sealing engagement with the extrusion and the outer edge extending beyond the extrusion and into overlying spaced position with respect to the remainder of the skylight and roof assembly and engageable therewith when the skylight portion is opened to limit the extent to which the skylight portion can be opened, the hinge comprising; a first leg adapted to be mounted on the pivotable skylight portion in fixed position, a second leg adapted to be mounted on the fixed portion of the assembly in fixed position, a flange extending from the second leg, mating surfaced on the first leg and the flange receiving coupling means for pivotally interengaging the first and second leg by the flange therebetween so that the pivotable skylight portion can be pivoted between the open and close positions along a desired arcuate path, the first leg having means thereon for mounting the first leg to the movable skylight portion, the second leg being U-shaped in configuration to capture a fixed portion of the assembly therein to be mounted thereon in fixed position, the flange extending from the free end of one side of the U-shaped second leg and laterally away from the structure captured within the U-shaped leg, and the flange having a predetermined size and the surfaces to receive the coupling means on the end of the flange being distal from the U-shaped leg, to permit pivoting of the movable skylight portion with respect to the fixed portion of the assembly so that it covers the roof opening when in the closed position with the extrusion in sealing engagement with the remainder of the skylight and roof assembly about substantially the entire periphery thereof and substantially across the width of the sealing extrusion and can be opened to expose the roof opening by pivoting the movable skylight portion more than 90 degrees away from the closed position by providing the outer edge of the upper dome with sufficient spacing from the fixed portion of the skylight and roof assembly.

* * * * *